US005388817A

United States Patent [19]

Chang

[11] Patent Number: 5,388,817

[45] Date of Patent: Feb. 14, 1995

[54] NOTE STACKER MECHANISM

[75] Inventor: Yuan F. Chang, Taipei, Taiwan, Prov. of China

[73] Assignee: Gameax Corporation, Taipei, Taiwan, Prov. of China

[21] Appl. No.: 132,199

[22] Filed: Oct. 6, 1993

[51] Int. Cl.[6] ..... B65H 29/44

[52] U.S. Cl. ..... 271/180; 271/219; 271/3

[58] Field of Search ..... 271/180, 181, 219, 314, 271/3

[56] References Cited

U.S. PATENT DOCUMENTS

| | | | |
|---|---|---|---|
| 4,722,519 | 2/1988 | Zouzoulas | 271/181 |
| 4,809,966 | 3/1989 | Kobayashi et al. | 271/181 |
| 4,809,967 | 3/1989 | Kondo | 271/181 |
| 4,858,744 | 8/1989 | Dolejs et al. | 271/181 |
| 5,195,739 | 3/1993 | Watabe | 271/181 |
| 5,209,395 | 5/1993 | Zouzoulas et al. | 271/181 |
| 5,251,738 | 10/1993 | Dabrowski | 271/181 |
| 5,288,066 | 2/1994 | Hain | 271/181 |

*Primary Examiner*—H. Grant Skaggs

*Attorney, Agent, or Firm*—Browdy and Neimark

[57] ABSTRACT

A notes stacker assembly comprises a stacker assembly, a stacking mechanism and a notes collector. When the notes are feeded into an inserting slot of the receiving slot, the notes will be moved forward by the main actuating wheel together with the pulley and second actuating wheel. Then the notes are moved to transferring slot and enter into the slot member of said stacking mechanism. Meanwhile, a signal is sent to the printed circuit triggering the motor of the stacking mechanism. The cam shaft is then moved by the motor and actuating the upper slot hole of the U-shape guiding block. Then the sensor of the printed circuit is covered and switched on. When the guiding block and the pressing plate is moved downward by the cam shaft, the small holes of the guiding slot will make the sensor receive a signal that the guiding block is moved to a right position. This will make the notes be received by the pressing plate and spring member, and enter into the note collector. When next signal is received, the guiding block is restored to its original position and make the sensor detect a closed signal. The guiding block will repeat this movement periodically to receive the notes.

4 Claims, 5 Drawing Sheets

NOTE STACKER MECHANISM

BACKGROUND OF THE INVENTION

This invention relates to a stacker mechanism, more particularly, to an improved note stacker mechanism with an excellent performance for accurately disposing of a plurality of notes into a note collector.

There are a plurality of note stackers in the market and that have a large dimension with a complicated configuration. Not only do they take a large space, but are also difficult to move from one location to another. Besides, because of poor design, existing stackers have a relatively low performance in stacking notes. On the other hand, it is difficulty to conduct routine maintenance, replacement and adjustment.

SUMMARY OF THE INVENTION

It is the object of this invention to provide an improved note stacker mechanism which can accurately dispose of a plurality of notes into a note collector.

It is still the object of this invention to provide an improved note stacker mechanism which is easy to maintain and replacement.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of an improved note stacker mechanism. In the drawings.

DETAILED DESCRIPTION OF A PREFERABLE EMBODIMENT

Figure 1:
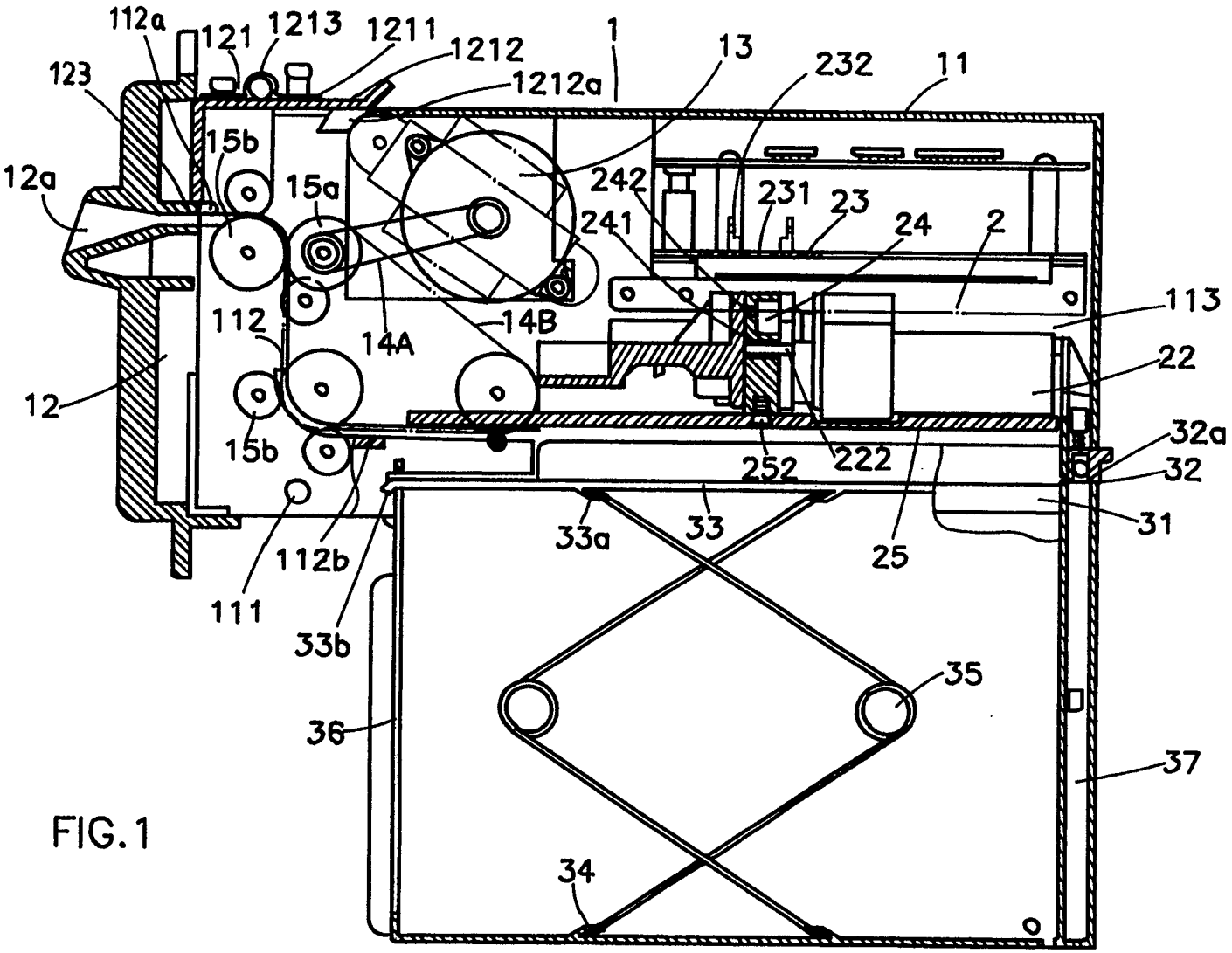
FIG. 1 is a cross sectional view of an improved note stacker mechanism showing the inner parts of said stacker.
Figure 2:
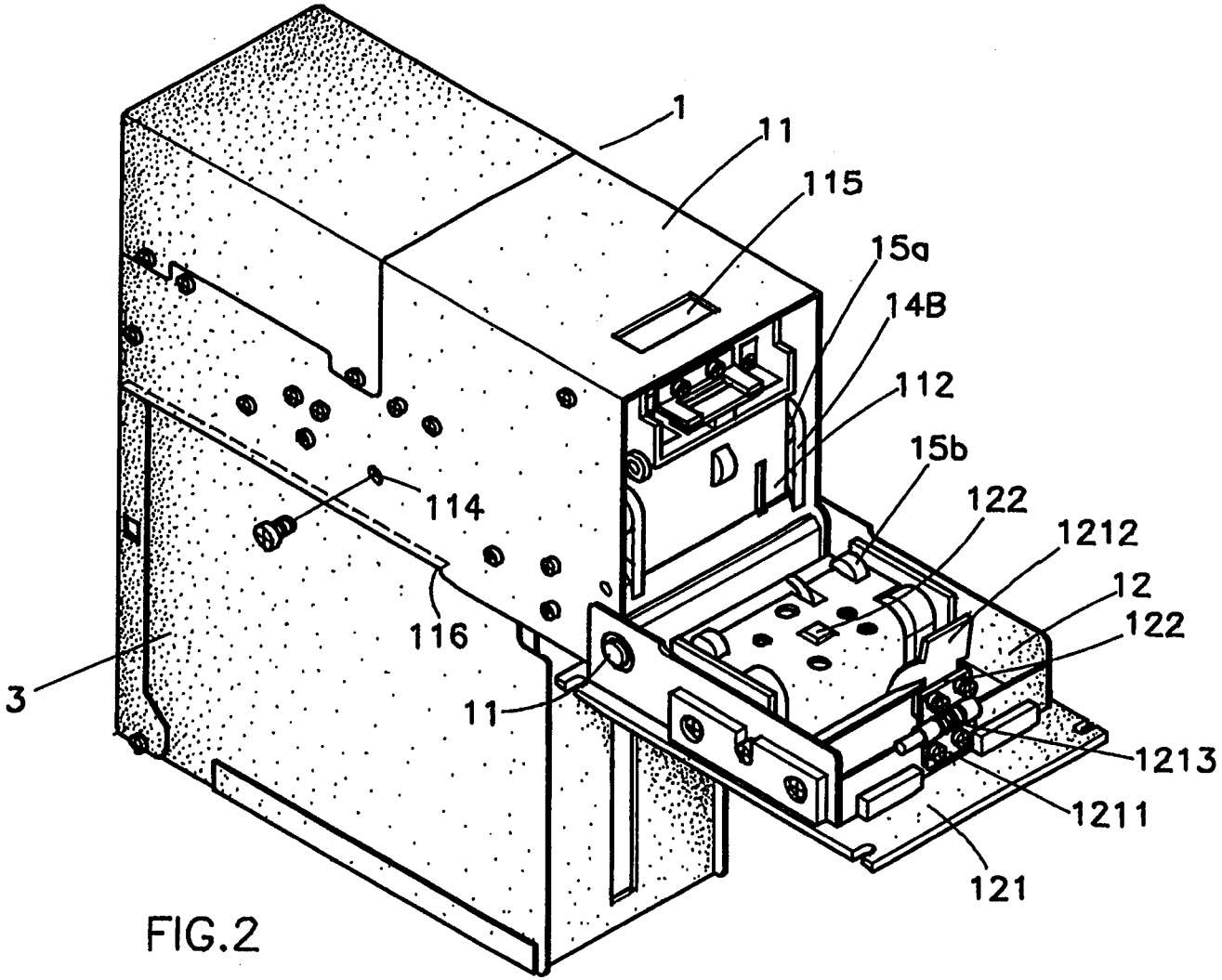
FIG. 2 is a perspective view of an improved note stacker mechanism.
Figure 3:
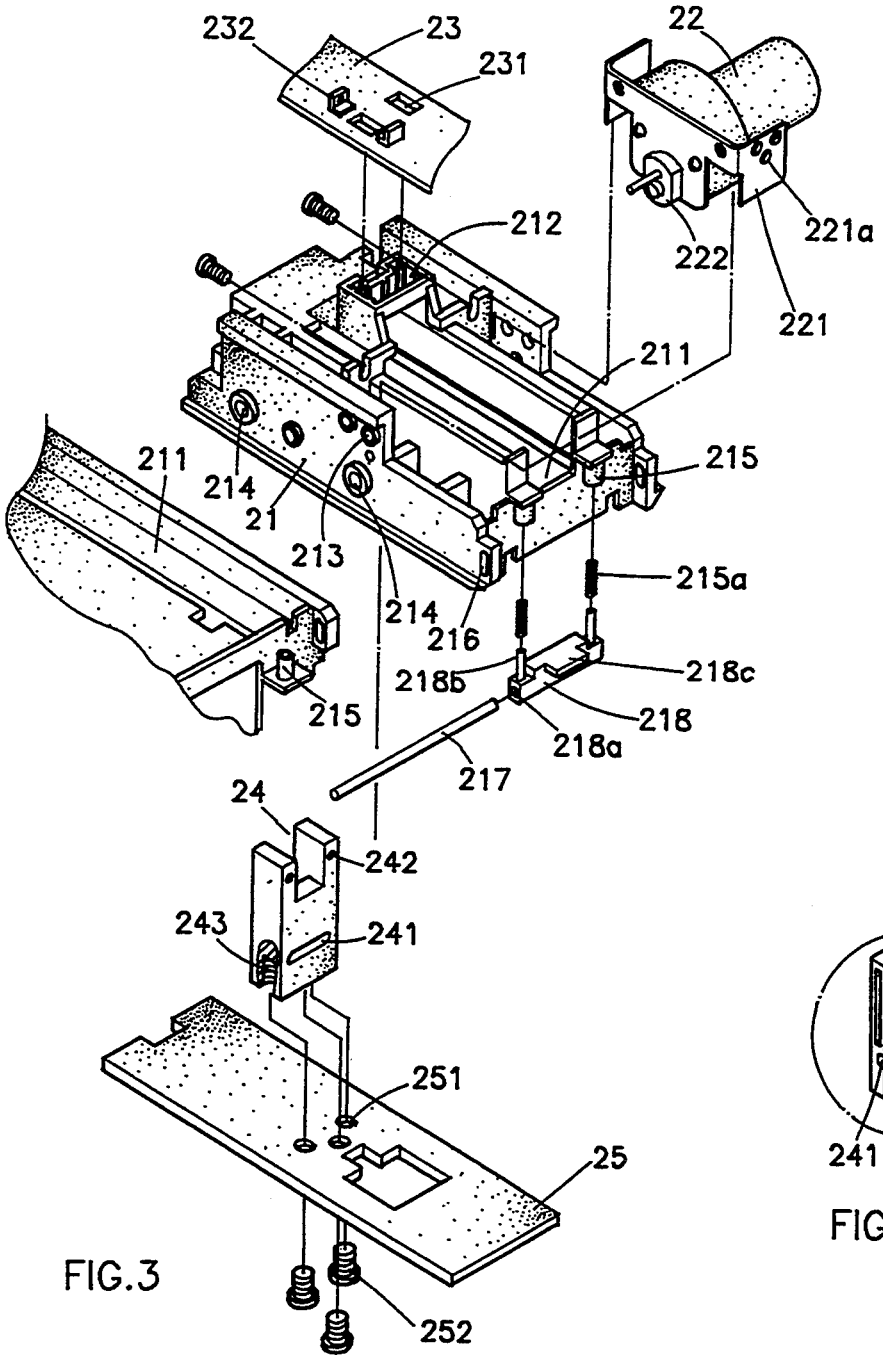
FIG. 3 is an exploded perspective view of an improved note stacker mechanism.
Figure 3A:
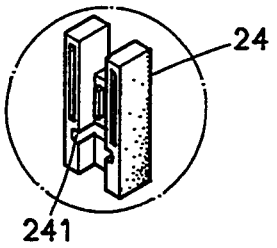
FIG. 3A is a partial view of the reverse side of block 24 as shown in FIG. 3.

Referring to FIGS. 1, 2 and 3, and particularly to FIG. 1, a note stacker mechanism is shown according to this invention generally comprising a stacker assembly 1, a stacking mechanism 2 and a note collector 3.

Said stacker assembly 1 comprises a housing 11 which has a rectangular shape. A note receiving slot 12 and an electric motor 13, and two pulleys 14*a*, 14*b* and actuating wheel 15 are disposed at a suitable position within said assembly 1. Said note receiving slot 12 is pivoted to said housing via a shaft 111. Said shaft 111 is fixed on housing 11 thereof via a clip disposed at both ends of said shaft 111. A transferring slot 112 is disposed at the front portion of said housing 11. A clipping slot 112*a* is disposed at the upper edge of said transferring slot 112. At the end portion of said clipping slot 112*a*, a tab 112*b* is disposed thereof. A collecting space 113 is defined at one side thereof and a plurality of locking holes 114 are provided at the sides of said housing 11 for positioning said stacking mechanism 2. Said housing 11 further comprises a clipping opening 115 and a pair of guiding tabs 116 are provided at the lower portion of said housing for slidably receiving a guiding rack 31 of said note collector 3. An entrance slot 12*a* is provided at the front surface of said note receiving slot 12. A clipping device 121 is provided at the upper edge of said notes collecting slot 12 for easily cleaning a magnetic head 122. Said clipping device 121 is attached to a clipping tab 1212 via a hinge 1211. A spring member 1213 is disposed at the middle portion of said hinge 1211. A pair of inclined hookers 1212*a* are provided at the said clipping tab 1212 for engaging with said clipping opening 115 of said housing 11. For a better clipping arrangement, a movable hooker 123 can be attached to said clipping slot 112*a* of said housing 11. By this arrangement, when the notes pass through, it can prevent said notes from being draw off. The operation of said note stacker mechanism is powered by said electric motor 13 together with accompanied pulley 14*a* which rotates a shaft on actuating wheel 15*a*. The main actuating wheel 15*a* actuates another main actuating wheel 15*a* via pulley 14*b*. By rotation of said pulley 14*b* and actuating wheel 15*b*, the notes are moved forward.

Referring to FIG. 3, said stacking mechanism 2 comprises a housing 21, an electric motor 22, a printed circuit board 23, an u-shape guiding block 24 and a pushing plate 25. A slot member 211 and an u-shape shaft supporting slot 212 are disposed within said housing 21. Said U-shape shaft supporting slot 212 is designed for the movement of said U-shape guiding block 24 which will actuate the movement of said pushing plate 25. A plurality of locking holes 213,214 are disposed at sides of said housing 21 for receiving bolt members inserted from said locking holes 114 of said housing 11. A pair of post slot 215 are disposed at one side of said housing 21 and a movable slot 216. A spring member 215*a* is disposed at said post slot 215 for receiving a pressing plate 218 via a pin member 217 received by a hole 218*a* and then received in said movable slot 216. A post 218*b* is disposed at said pressing plate 218 and a clipping tab 218*c* is provided at the middle portion of said pressing plate 218. An arc-shape plate 221 is locked to the front portion of said motor 22. A locking hole 221*a* is disposed respectively on both sides of said plate 221. A cam shaft 222 is disposed on said motor 22 which transfer the movement to said U-shape guiding block 24. A printed circuit 23 are provided with a pair of locking holes 231 and a sensor 232 for extending of said U-shape guiding block 24. A plurality of holes 241 and 242 are provided at said guiding block 24 for screwing in screw member 252 from said locking hole 251 of said pushing plate 25.

A note collector 3 is provided with a guiding rack 31 on both sides. A guiding plate 32 are provided at the upper edge. A cutout 32*a* is provided at the end portion of said guiding plate 32. Said note collector 3 further comprises a pressing plate 33 therein. A hooker 34, 33*a* are provided at said note collector 3 and said pressing plate 33 respectively for positioning a spring member 35. A tab 33*b* is disposed at said pressing plate 33. Hence said pressing plate 33 is pressed to move within a slot 36. A cover plate 37 is disposed at one side for removing the notes.

The operation of the notes stacker assembly according to this invention will be described below.

As shown in FIG. 2, the release of said note receiving slot 12 can be easily released from said housing 1 by releasing said hooker 1212*a* of said clipping tab 1212 from said clipping opening 115 of said housing 11. Then the magnetic head 122 can be easily cleaned.

Figure 4:
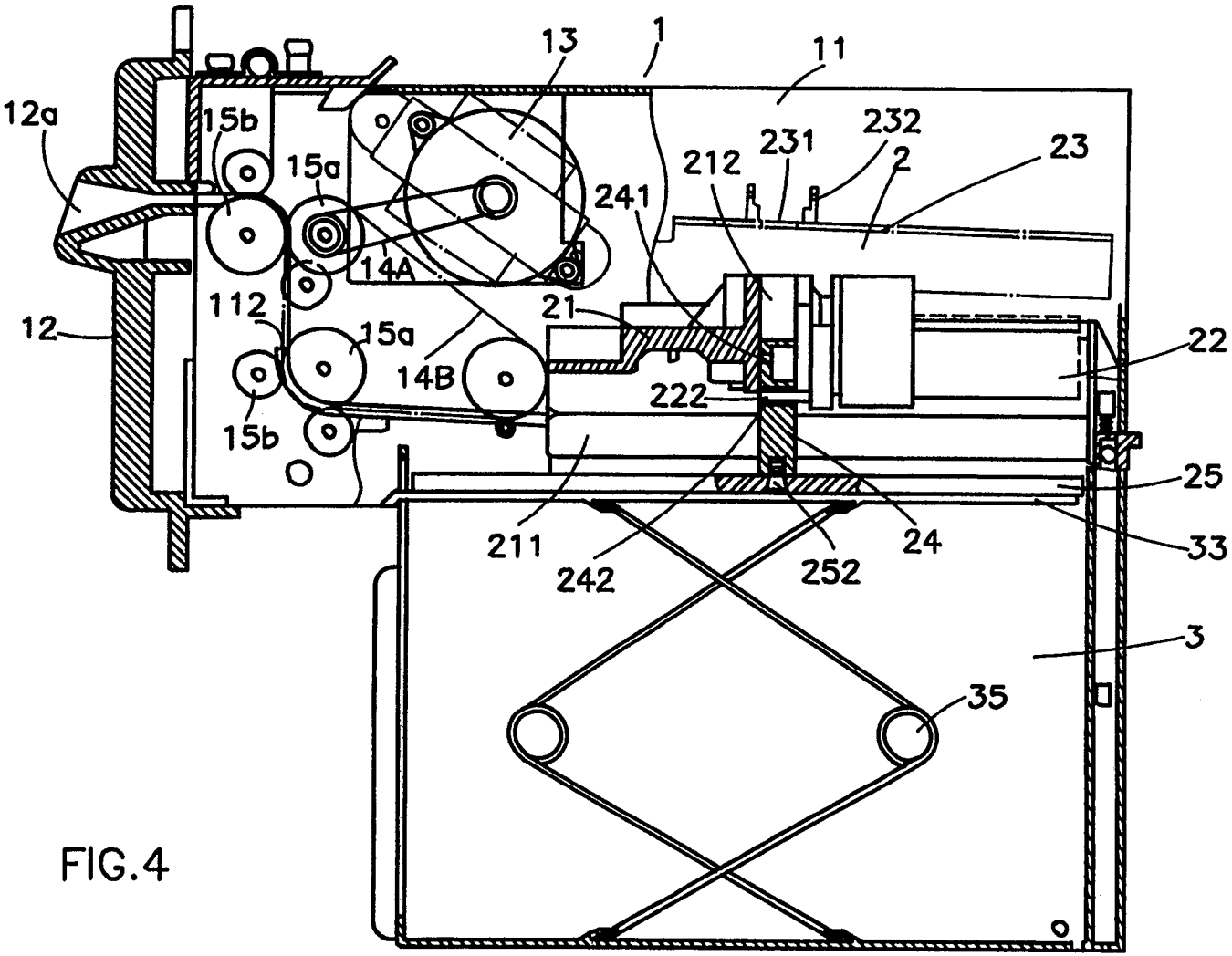
FIG. 4 is a cross sectional view of an improved note stacker mechanism showing the moving parts.

As shown in FIG. 4, when the notes are feeded into an inserting slot 12*a* of said receiving slot 12, said notes will be moved forward by said main actuating wheel 15*a* together with said pulley 14*b* and second actuating wheel 15*b*. Then the notes are moved to transferring slot 112 and enter into said slot member 211 of said stacking mechanism 2. Meanwhile, a signal is sent to said printed circuit 23 triggering said motor 22 of said stacking mechanism 2. The cam shaft 222 is then moved by said motor 22 and slides in said upper slot hole 241 of said U-shape guiding block 24. Then said sensor 232 of said printed circuit 23 is covered and switched on. When said guiding block 24 and said pressing plate 25 is moved downward by said cam shaft 222, said small holes 242 of said guiding block 24 will make said sensor 232 receive a signal that said guiding block 24 is moved to a right position. This will permit notes to be received by said pressing plate 33 and spring member 35, and enter into said note collector 3. When the next signal is received, said guiding block 24 is restored to its original position and makes sensor 232 detect a closed signal. The guiding block 24 will repeat this movement periodically to receive the notes.

Figure 5A:
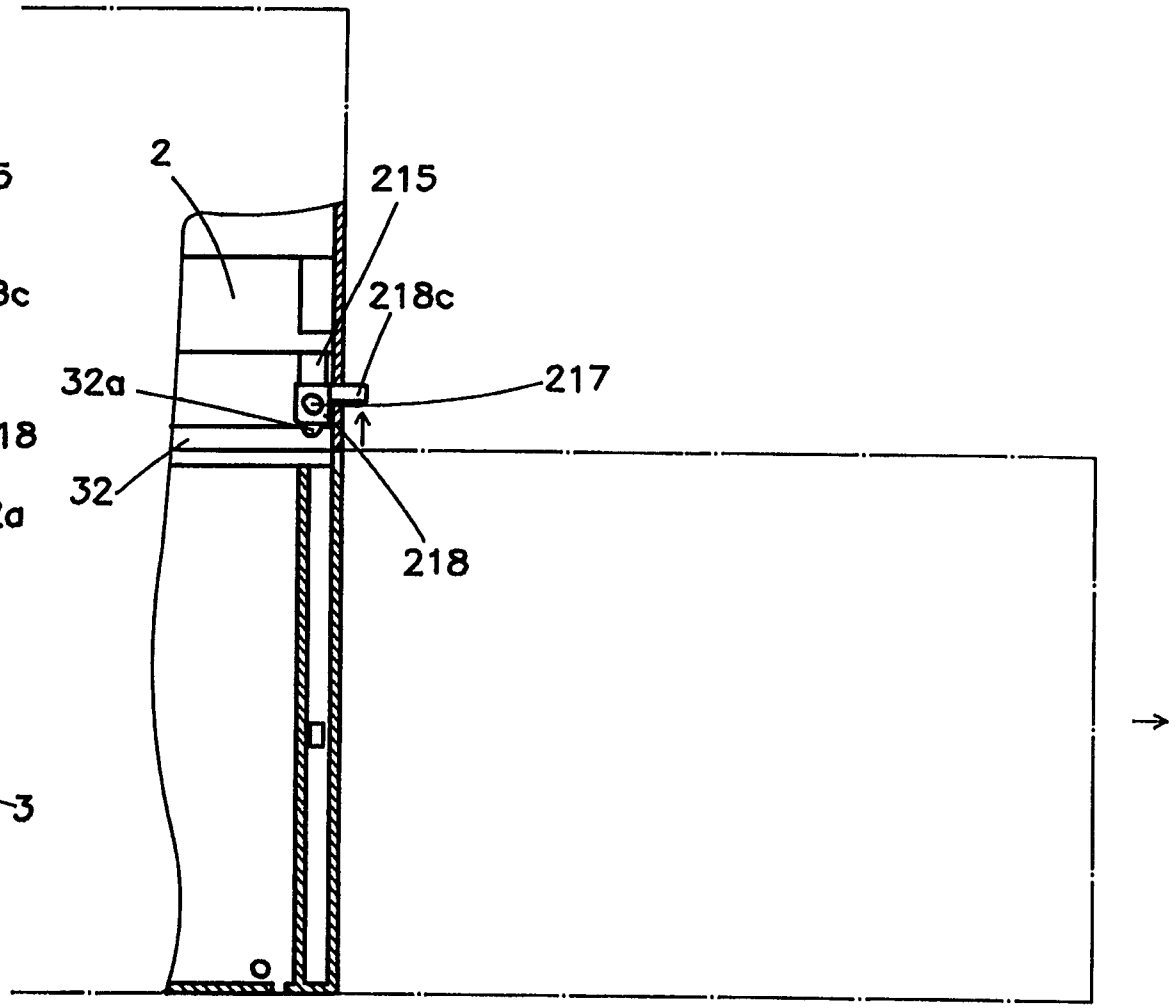
FIGS. 5A and 5B are a cross sectional view of a note collector showing a plurality of notes disposed therein.
Figure 5B:
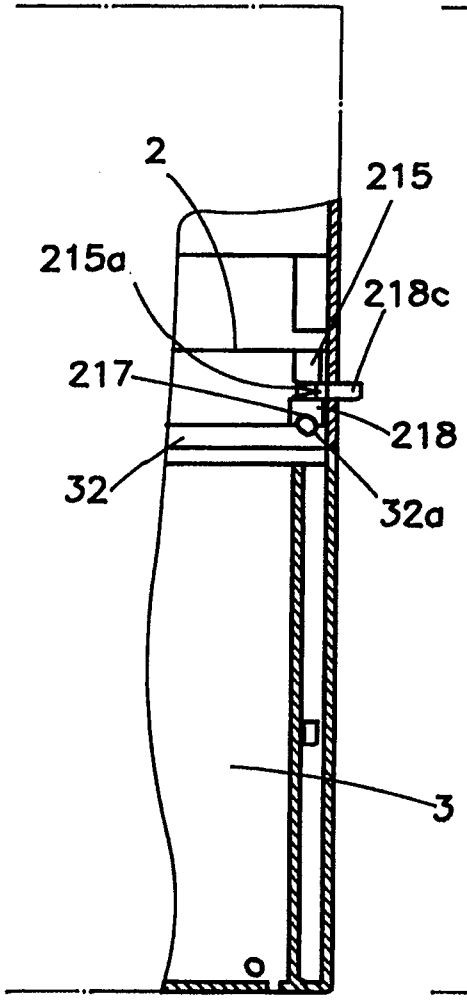

As shown in FIGS. 5A and 5B, when said clipping tab 218*c* of said pressing plate 218 is pulled upward, said pin member 217 will be released from said cutout 32*a* of said guiding plate 32 of said collector 3, then said collector 3 can be readily removed therefrom. When said collector 3 shall be installed again, said spring member 215*a* located within said pin member 217 will actuate an engagement between said pin member 217 and said cutout 32*a* of said note collector 3.

This invention can be concluded into the following advantages.

1) The notes can be accurately received within said collector.
2) The assembly can be readily disassembly to clear the inner parts.
3) The pressing plate and spring member will facilitate a readily assembly and positioning of the member.
4) The dimension of this invention is quite small as compared with the prior art. It is easy to manufacture and decrease the cost.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A note stacker mechanism comprising:

a stacker assembly, a stacking mechanism, and a note collector, said stacker assembly comprising;

a rectangular housing, a note receiving portion having slot means extending from a front surface of said receiving portion to said stacking mechanism for delivery of a note, note transporting means for gripping the note and transporting the note from the note receiving portion through said slot means to said stacking mechanism, said note receiving portion being pivoted to said housing around a shaft fixed to said housing by a clip disposed at each end of said shaft, said note receiving portion having a magnetic head therein, said housing having a clipping opening and a pair of guiding tabs, each of said guiding tabs slidably engaged to a guiding rack on each longitudinal side of said note collector, fastening means provided at an upper edge of said note receiving portion for engaging said clipping opening, said fastening means being releasable to permit pivoting of said receiving portion and cleaning of said magnetic head, said stacking mechanism having a frame fixed at an interior of said housing, said frame having a space to receive a note from said slot means, an electric motor fixed on said frame, a printed circuit engaged on said frame actuating said motor when a note passes said magnetic head, a U-shaped guiding block slideably engaged in a corresponding U-shaped slot on said frame, said U-shaped guiding block fixed to a pushing plate, wherein, when said motor is actuated a cam shaft on said motor moves said U-shaped guide block within said corresponding U-shaped slot, a guide plate being provided at an upper edge of said note collector, a cutout being provided at an end portion of said guide plate, spring biased means on said frame releasably engaged in said cutout of said guide plate, said spring biased means having a clipping tab permitting said spring biased means to be manually disengaged from said cutout and said note collector to be removed from said housing, a pressing plate having a tab slideably engaged in a slot on said note collector, said pressing plate being spring biased within said note collector toward said pushing plate, wherein at selected positions of said U-shaped block in said corresponding slot a sensor on said printed circuit is switched on to move said U-shaped block to permit a note to be received on said pressing plate and into said note collector, said note collector having a cover plate disposed at one side for removing notes.

2. A stacker mechanism as recited in claim 1, wherein said fastening means is attached to a clipping tab by a hinge, a spring member being disposed at a middle portion of said hinge, a pair of inclined hooks being provided on said clipping tab for engaging with said clipping opening under the pressure of said spring member.

3. A stacker mechanism as recited in claim 1, wherein a movable hook is attached to said slot of said housing, wherein when a note passes through, the hook prevents said note from being draw off.

4. A stacker mechanism as recited in claim 1, wherein when said cam shaft is moved by said motor and moves said U-shaped guiding block, said sensor of said printed circuit is covered and switched on said U-shaped guiding block repeating movement periodically to receive a note.

* * * * *